US005873478A

United States Patent [19]

Sullivan et al.

[11] Patent Number: 5,873,478

[45] Date of Patent: Feb. 23, 1999

[54] SPILL-PROOF CAP FOR BEVERAGE CONTAINERS

[76] Inventors: Michael J. Sullivan; Lynn A. Sullivan, both of 5 Normandy La., Little Rock, Ark. 72207

[21] Appl. No.: 782,290

[22] Filed: Jan. 13, 1997

[51] Int. Cl.[6] ..... A47G 19/22

[52] U.S. Cl. ..... 215/389; 215/902; 220/714; 220/367.1; 220/705; 222/482; 222/534

[58] Field of Search ..... 222/534, 482, 222/481.5; 220/708, 367.1, 705, 373, 714, 717; 215/389, 388, 902, 11.4, 11.5, 11.1, 235, 236

[56] References Cited

U.S. PATENT DOCUMENTS

| | | | |
|---|---|---|---|
| D. 351,761 | 10/1994 | Feer . | |
| D. 358,301 | 5/1995 | Brown et al. . | |
| D. 369,943 | 5/1996 | Dark . | |
| 2,800,245 | 7/1957 | Doyle et al. | 220/373 |
| 3,323,689 | 6/1967 | Elmore | 222/482 |
| 3,490,659 | 1/1970 | La Vange et al. | 222/534 |
| 3,516,581 | 6/1970 | Micallef | 222/534 X |
| 3,776,428 | 12/1973 | Hazard | 222/534 X |
| 3,782,577 | 1/1974 | Levey . | |
| 3,840,153 | 10/1974 | Devlin . | |
| 4,165,816 | 8/1979 | Tupper | 220/373 X |
| 4,239,132 | 12/1980 | Mueller et al. | 220/367.1 X |
| 4,632,266 | 12/1986 | Osswald | 222/534 X |
| 4,732,303 | 3/1988 | Wang . | |
| 4,776,494 | 10/1988 | Holoubek . | |
| 4,892,234 | 1/1990 | Bennett . | |
| 4,903,870 | 2/1990 | La Vange | 222/534 X |
| 5,065,909 | 11/1991 | Pino et al. . | |
| 5,079,013 | 1/1992 | Belanger . | |
| 5,133,482 | 7/1992 | Burrows et al. | 222/481.5 X |
| 5,242,079 | 9/1993 | Stephens et al. . | |
| 5,294,018 | 3/1994 | Boucher | 215/388 X |
| 5,337,918 | 8/1994 | Wang . | |
| 5,392,968 | 2/1995 | Dark | 222/534 X |
| 5,509,551 | 4/1996 | Terrell, II . | |
| 5,540,341 | 7/1996 | Holley et al. . | |
| 5,542,585 | 8/1996 | Peters et al. | 222/534 X |
| 5,542,670 | 8/1996 | Morano . | |
| 5,582,315 | 12/1996 | Reid . | |
| 5,655,686 | 8/1997 | Jermyn | 222/481.5 X |

FOREIGN PATENT DOCUMENTS

| | | | |
|---|---|---|---|
| 522021 | 3/1955 | Italy | 222/482 |

OTHER PUBLICATIONS

Playtex Products Inc., "Spill–Proof™Cup", packaging (1 page).

*Primary Examiner*—Stephen K. Cronin
*Assistant Examiner*—Robin A. Hylton
*Attorney, Agent, or Firm*—Dinesh Agarwal

[57] ABSTRACT

A spill-proof cap or lid for a standard beverage container, such as a soft drink, water and other liquid bottle, includes a housing which is configured to fit over the container opening. The housing includes top and bottom, each of which includes a recess. A spout is mounted in the top recess and is pivotable between open and closed positions. A flow control section extends generally vertically in the bottom recess for receiving a flow control member. The flow control member is removably positioned in the flow control section and includes a flow control valve and an air intake valve. The spout includes at least one passageway which is in fluid communication with the bottom recess through a passageway extending between the top and bottom of the housing. In use, the cap is substituted for the conventional cap or lid that the typical soft drink, water or other liquid bottle is equipped with. When the spout is flipped upwardly in the open position, and a suction pressure is applied, the liquid from inside the bottle flows out through the spout passageway. When the suction pressure on the spout is released, the flow of liquid stops. Upon flipping the spout to the horizontal closed position, any risk of spilling or dripping is avoided.

10 Claims, 2 Drawing Sheets

SPILL-PROOF CAP FOR BEVERAGE CONTAINERS

FIELD AND HISTORICAL BACKGROUND OF THE INVENTION

The present invention is directed to a cap or lid for beverage containers, and more particularly to a spill-proof cap which would easily fit a standard beverage container, such as a screw-top soft drink or water bottle commonly available in the market place.

At the present time, soft drink, water, and other liquid containing bottles are sold with tops or lids which must be removed to gain access to the liquid contained therein. Generally speaking, these types of bottles or containers are made for adults who either pour the contents of the container into another cup or drink directly therefrom. Although adults often drink directly out of these types of bottles, spilling is generally not a concern. This is different, however, for babies, toddlers, and particularly small children who like drinking out of the container to emulate adult behavior. It is not uncommon that small children, in attempting to drink directly out of a container, spill the liquid due to unforeseen events, such as an accident or careless handling of the container. Presently, supervising adults pour the contents from the container into another cup that is generally fitted with lids or caps which may prevent dripping or spilling of the liquid. Various examples of these types of cups are shown in U.S. Pat. Nos. 3,840,153; 5,065,909; 5,242,079; 5,079,013; 5,337,918; 5,540,341 and 5,542,670. Examples of beverage container caps are disclosed in U.S. Pat. Nos. 3,782,577 and 5,509,551. The Playtex Products, Inc., also markets a Spill-Proof™ cup covered by U.S. Pat. No. 5,079,013.

The conventional caps or lids either cannot be used to fit a standard soft drink or water bottle, or do not effectively prevent spilling or dripping of the liquid when used by small children. There is, therefore, a need in the industry for a spill-proof cap for standard soft drink, water, or other liquid containing bottles currently available on the market, which can be easily used by small children to drink the liquid directly out of the bottle without spilling or dripping.

OBJECTS AND BRIEF SUMMARY OF THE INVENTION

The principal object of the present invention is to provide a spill-proof cap for a standard soft drink, water, and other liquid containing bottles or containers.

Another object of the present invention is to provide a spill-proof cap for a beverage container which would easily fit a standard soft drink, water and other liquid bottles, currently available on the market place, and which can be easily used by small children without spilling or dripping the liquid.

Yet another object of the present invention is to provide a spill-proof cap for a beverage container which allows small children to drink liquids directly out of the container emulating adult behavior and without spilling or dripping.

Yet another object of the present invention is to provide a spill-proof cap for a beverage container which eliminates the necessity for adults to carry along separate cups for use by children. In other words, since children can drink directly out of the bottle available on the market, there is no need to carry a conventional cup or other similar container for pouring the liquid therein prior to drinking.

An additional object of the present invention is to provide a spill-proof cap for a beverage container which includes a closable spout for preventing spills when the container is in storage.

Yet an additional object of the present invention is to provide a spill-proof cap for beverage container which is versatile in that it can be reused on other containers.

Still yet an additional object of the present invention is to provide a spill-proof cap for a beverage container which is kid-friendly and allows the adults the convenience of buying a bottle off-the-shelf and mounting the cap of the invention without any concern for spilling or dripping.

In summary, the main object of the present invention is to provide a spill-proof cap or lid which can be easily used on a standard soft drink, water, or other liquid bottle or container, by small children to drink the liquid directly out from the bottle without spilling or dripping.

BRIEF DESCRIPTION OF THE DRAWINGS

The above and other objects, and other features and advantages of the present invention will become apparent from a consideration of the following detailed description of the invention illustrated in the accompanying drawings, in which.

DETAILED DESCRIPTION OF THE INVENTION

Figure 1:
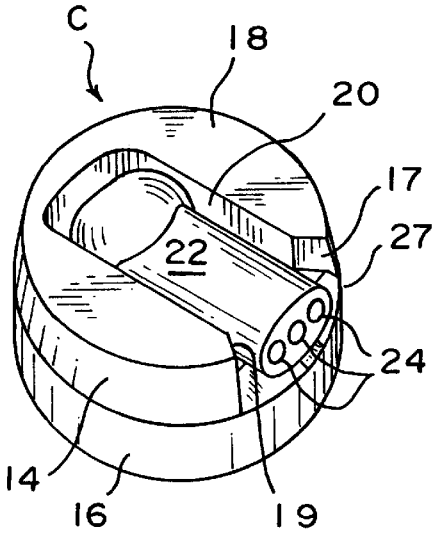
FIG. 1 is a left perspective view of the spill-proof cap of the invention.

As best shown in FIG. 1, the spill-proof cap C of the present invention preferably has the configuration of a generally round housing 10, which is unitary in construction and made of a conventional plastic or the like material. In particular, the cap C is preferably made of materials, such as polyvinyl chloride (PVC), any high-density polyethylene or the like, thermoplastic, or other suitable material, which may be easily molded, blown or otherwise shaped to obtain the desired configuration.

Figure 5:
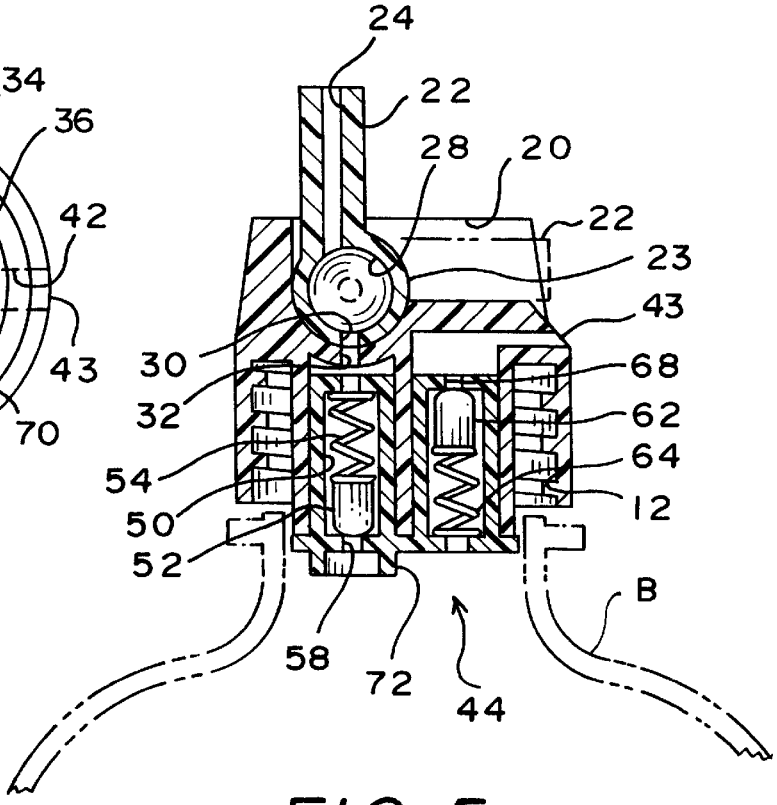
FIG. 5 is a cross-sectional view taken along line 5—5 of FIG. 2, shown with the spout in the open position.

The housing 10 has dimensions to fit various commonly available soft drink, water or other liquid containing bottles or containers available in the market place. In particular, housing 10 is provided with screw-threads 12, which preferably match or are similar to the screw-threads provided on the caps that the commonly available drink bottles are equipped with. As best shown in FIG. 5, a user would normally remove the conventional cap that a conventional bottle B is equipped with and screw-on the spill-proof cap C of the invention.

Figure 4:
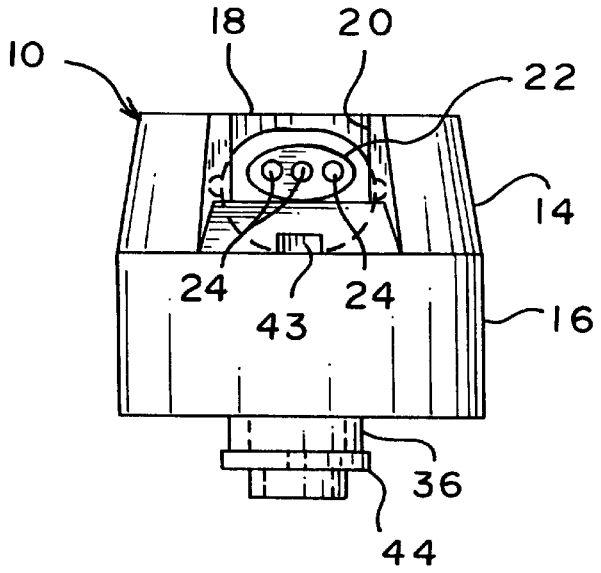
FIG. 4 is a front elevational view of the cap shown in FIG. 1.
Figure 6:
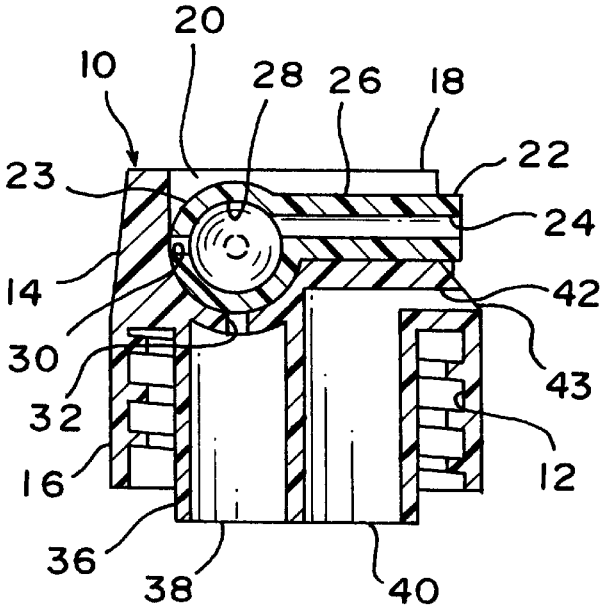
FIG. 6 is a view similar to FIG. 5, shown without the flow control member and the spout in the closed position.

Referring now to FIGS. 1, 4 and 6, housing 10 includes top portion 14 and bottom portion 16. The top portion 14 is slightly tapered toward the top surface 18 and has a diameter slightly less than the diameter of bottom portion 16.

The top portion 14 includes a horizontally extending linear recess 20 for accommodating drinking spout 22. As best shown in FIGS. 5 and 6, spout 22 pivots between a vertical, open position (FIG. 5) and a horizontal, closed position (FIG. 6). The spout 22 preferably includes three flow passageways 24 which extend only in the nozzle section 26 of the spout 22, but are in fluid communication with a single spout chamber 28. (It is noted herewith that the number of flow passageways in the spout can be varied to control and regulate the liquid flow. The preferable provision of three narrow passageways, as opposed to a single large passageway, results in somewhat less overwhelming liquid flow for small children.)

A base passageway 30 in the round spout base 23, is in fluid communication with passageway 32 in housing 10, when the spout 22 is in the open position (FIG. 5).

Figure 2:
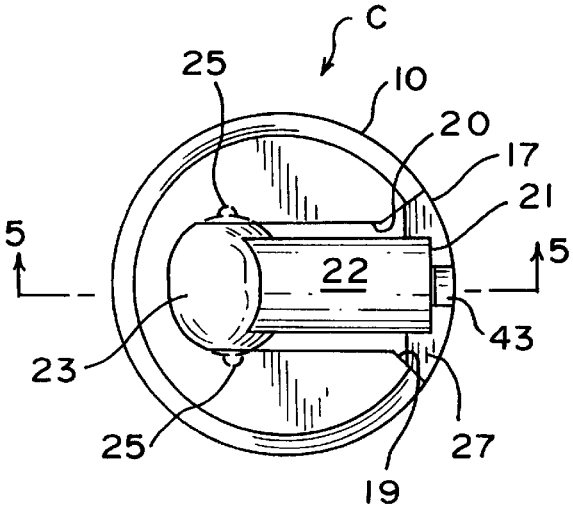
FIG. 2 is a top plan view of the cap shown in FIG. 1.

As shown in FIG. 2, spout 22 on each side of its base section 23, is provided with a projection 25 which is received in a corresponding notch in housing 10, in the known manner. The provision of projections 25 allows the user to easily flip-up or down the spout 22 and keeps it aligned and properly seated in recess 20. In this regard, in order to further facilitate pivoting of the spout 22 from the horizontal, closed position, upper section 14 of housing 10 includes an outwardly sloping edge 27, and the length of spout 22 is kept slightly short of the housing periphery. In this manner, the free end 21 of the spout 22 overlies the edge 27 to thereby allow the user to insert a finger or a suitable implement therebetween to easily flip-up the spout 22. The access to spout end 21 is further facilitated by the outwardly flared corner surfaces 17 and 19 of upper section 14.

Figure 3:
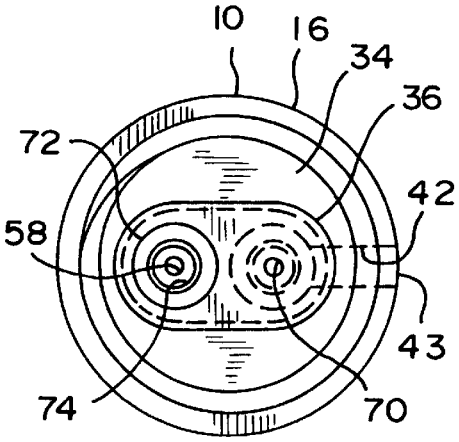
FIG. 3 is a bottom plan view of the cap shown in FIG. 1.

As best shown in FIG. 3, housing 10 includes recess 34 in bottom portion 16. A generally oval-shaped flow control section 36 extends generally vertically in bottom recess 34. (It should be noted that it is within the scope of the invention to employ other configurations or shapes.) As best shown in FIG. 6, flow control section 36 includes a flow control tube 38 and a contiguous air intake tube 40. The air intake tube 40 communicates with the exterior by air intake passageway 42 which extends radially in housing 10. An opening 43 allows air from the exterior to flow through intake passageway 42 and into air intake tube 40.

As best shown in FIGS. 5 and 6, passageway 32 allows spout passageway 30 to communicate with flow control tube 38, when spout 22 is in the open position, as shown in FIG. 5.

Figure 7:
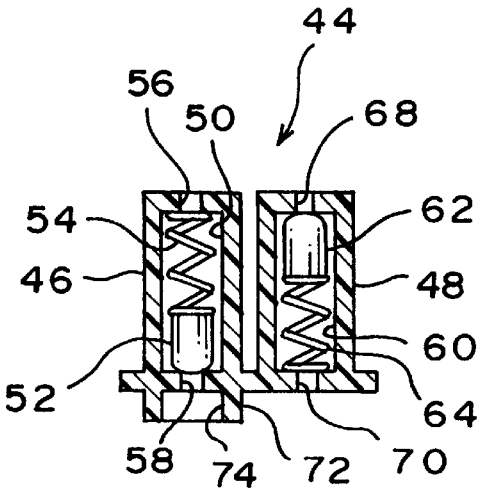
FIG. 7 is a cross-sectional view of the flow control member.

In reference now to FIG. 7, a flow control member 44 is illustrated, which is preferably unitary in construction and integrally formed of a suitable material for being easily received in flow control section 36. In particular, flow control member 44 includes tubular flow control valve 46 and a contiguous tubular air intake control valve 48. The shape, configuration and dimensions of the valves 46 and 48 are selected to be complementary to easily fit into corresponding tubes 38 and 40 in housing 10. In other words, while it is preferable that members 38 and 40, and valve 46 and 48, be generally tubular in cross-section, it is within the scope of this invention to select other shapes and configurations. The main purpose is that flow control member 44 should be frictionally, snugly and removably positioned in flow control section 36 in an air-tight manner.

In continuing reference to FIG. 7, flow control valve 46 includes interior recess 50 which accommodates valve member 52 biased by spring 54. The interior recess 50 communicates with the exterior through top passageway 56 on one end, and bottom passageway 58 on the opposite end. As best shown in FIGS. 5 and 7, bottom passageway 58 is normally kept closed by valve number 52 due to the force exerted by spring 54. In the like manner, air intake control valve 48 includes interior recess 60 which accommodates valve member 62 biased by spring 64. The valve 48 also communicates with the exterior through top passageway 68 on one end, and bottom passageway 70 on the opposite end. Under normal circumstances, passageway 68 would remain closed by valve number 62 due to the force exerted by spring 64.

The flow control number 44 further includes a relatively short generally tubular flow diverting channel member 72, which is preferably coaxially disposed with flow control valve 46. The channel member 72 includes open ended recess 74 for diverting the liquid from bottle B toward flow control valve 46.

USE AND OPERATION

In use, the cap C of the invention would be substituted for the conventional cap that the soft drink, water or other liquid bottles, are generally equipped with. Accordingly, upon obtaining a conventional bottle or container, its cap would be unscrewed and cap C of the invention would be screwed thereon. When desired, a child or adult could easily flip up spout 22 to drink the contents of the bottle.

As best shown in FIG. 5, when the spout 22 is in the open position, passageways 24 in spout 22 are in fluid communication with the interior of the bottle via passageways 30 and 32. In this position, when the user applies a sucking action on spout 22, negative pressure is created in the interior recess 46 of flow control valve 46. This causes valve member 52 to move upwardly against spring pressure to thereby open bottom passageway 58, thereby resulting in a flow of the liquid from the bottle B.

As the liquid begins to flow through passageway 58 to interior recess 50, and through passageway 56 to the spout through passageways 30 and 32, a low pressure condition is created in the bottle due to the liquid flowing outwardly. This condition causes valve member 62 to move downwardly (FIG. 5) thereby opening passageway 68 to allow the air from the exterior to flow inwardly into the bottle via opening 43. Any differential in air pressure between the interior and the exterior of the bottle is therefore equalized. It can be seen that, as a result, a flow of liquid from inside the bottle B to the outside, through spout 22, is maintained as long as suction is applied by the user on the spout 22. Once the suction pressure on spout 22 is released, valve 52 returns to its normal position by the force of spring 54, thereby closing bottom passageway 58 and stopping the flow of liquid from the interior of the bottle. Since the flow of liquid stops, the pressure differential between the interior and the exterior of the bottle (as a result of liquid leaving the bottle) ceases to exist and valve member 62 returns to its normal position due to the force of spring 64, thereby closing top passageway 68. In this situation, no liquid from the interior of the bottle can flow to spout 22, since passageway 58 remains closed by valve member 52. Accordingly, even in the open (up) position of spout 22, liquid from the interior of the bottle does not flow outwardly and the risk of spilling or dripping is eliminated.

It can be seen, however, that any malfunctioning of flow control number 44, or wear due to continued usage, may cause improper or insufficient closing of bottom passageway 58, thereby allowing the liquid to flow to spout 22. In order to prevent the risk of this condition, the unique cap C of the invention allows the user to pivot spout 22 to the closed position, as shown in FIGS. 1 and 6. In the closed position of spout 22, even if the liquid from the inside of the bottle flows through flow control valve 46, it cannot escape into spout 22 since the passageway 30 in the bottom of the spout, is out of alignment with and no longer in fluid communication with the passageway 32 in the housing. Accordingly, any risk of spilling or dripping is further avoided.

The cap C of the invention is therefore unique in allowing a child to emulate adult behavior by drinking directly out of a commonly available bottle or container without any risk of spilling or dripping. Further, since the cap C of the invention is made to fit the commonly available soft drink, water or other liquid bottles, it is no longer necessary for adults to carry along a separate container for pouring the liquid. In other words, adults only need to carry the cap of the invention, which is relatively small, reusable, kid friendly and has a broad container compatibility.

While this invention has been described as having a preferred design, it is understood that it is capable of further modifications, uses and/or adaptations following in general the principle of the invention, and including such departures from the present disclosure as come within the known or customary practice in the art to which the invention pertains, and as may be applied to the central features hereinbefore set forth, and fall within the scope of the invention and of the limits of the appended claims.

What is claimed is:

1. A spill-proof cap for a beverage container, comprising:

a) a housing configured to fit over a container opening;

b) said housing including a top and a bottom, each of said top and bottom including a recess;

c) a spout mounted in said top recess and pivotable between open and closed positions;

d) first and second generally tubular members positioned substantially vertically in said bottom recess;

e) a flow control member removably positioned in said bottom recess and including a flow control valve and an air intake valve;

f) said flow control valve being received in said first tubular member and said air intake valve being received in said second tubular member;

g) said spout including a first passageway;

h) said housing including a second passageway extending between the top and bottom thereof and in fluid communication with said first passageway when said spout is in said open position;

i) said housing including a periphery interrupted by a radially outwardly inclined edge, j) said spout including a free end portion, and k) said free end portion overlying said inclined edge when said spout is in said closed position.

2. The spill-proof cap of claim 1, wherein:

a) said housing includes an air inlet passageway having a first opening in communication with the exterior of the cap; and b) said air inlet passageway having a second opening in communication with said second tubular member.

3. The spill-proof cap of claim 1, wherein:

a) said spout extends within said periphery.

4. The spill-proof cap of claim 1, wherein:

a) said top recess is generally linear and extends along a first axis; and b) said first and second tubular members are positioned adjacent to each other along a line extending parallel to said first axis.

5. The spill-proof cap of claim 2, wherein:

a) said air inlet passageway extends radially in said housing and is generally parallel to said spout in said closed position thereof.

6. The spill-proof cap of claim 2, wherein:

a) said air inlet passageway extends radially and generally at a right angle to said spout in said open position thereof.

7. The spill-proof cap of claim 2, wherein:

a) said air inlet passageway extends generally at a right angle to said second tubular member.

8. The spill-proof cap of claim 1, wherein:

a) said spout includes third and fourth passageways running generally parallel to said first passageway.

9. The spill-proof cap of claim 1, wherein:

a) each of said flow control and air intake valves comprises a spring-biased valve.

10. The spill-proof cap of claim 1, wherein:

a) said top of said housing has a diameter less than the diameter of said bottom thereof.

* * * * *